US009835357B2

(12) United States Patent
Taylor

(10) Patent No.: US 9,835,357 B2
(45) Date of Patent: Dec. 5, 2017

(54) CYLINDRICAL TUBULAR HEAT EXCHANGER TYPE 2

(71) Applicant: Ronald Paul Taylor, Pelican Lake, WI (US)

(72) Inventor: Ronald Paul Taylor, Pelican Lake, WI (US)

( * ) Notice: Subject to any disclaimer, the term of this patent is extended or adjusted under 35 U.S.C. 154(b) by 287 days.

(21) Appl. No.: 14/693,858

(22) Filed: Apr. 22, 2015

(65) Prior Publication Data

US 2016/0313075 A1 Oct. 27, 2016

(51) Int. Cl.

| | |
|---|---|
| ***F28D 1/06*** | (2006.01) |
| ***F24H 3/00*** | (2006.01) |
| ***F28F 9/02*** | (2006.01) |
| ***F28D 7/16*** | (2006.01) |
| *F28D 21/00* | (2006.01) |

(52) U.S. Cl.

CPC ..... *F24H 3/00* (2013.01); *F28D 7/1669* (2013.01); *F28F 9/02* (2013.01); *F28D 2021/0024* (2013.01)

(58) Field of Classification Search

CPC ..... F24H 3/00; F28F 9/02

USPC ..... 29/890.03, 890.045, 890.031; 165/76, 165/157, 177, 178

See application file for complete search history.

(56) References Cited

U.S. PATENT DOCUMENTS

| | | | | |
|---|---|---|---|---|
| 3,339,260 | A * | 9/1967 | Burne | B21D 53/06 165/154 |
| 4,098,329 | A * | 7/1978 | Culver | F28D 7/1669 122/32 |
| 4,221,262 | A * | 9/1980 | Baumgaertner | F28D 7/1669 122/32 |
| 5,161,605 | A * | 11/1992 | Gutlhuber | B01J 8/067 165/103 |
| 2003/0102116 | A1* | 6/2003 | Memory | F28D 1/05366 165/173 |
| 2006/0187751 | A1* | 8/2006 | Lepine | F28C 3/04 366/336 |
| 2013/0224104 | A1* | 8/2013 | Naterer | C01B 3/08 423/648.1 |

* cited by examiner

*Primary Examiner* — Nina Bhat

(74) *Attorney, Agent, or Firm* — Garrett James O'Sullivan; Eric Brandon Lovell; Timothy Marc Shropshire

(57) ABSTRACT

In accordance with the present invention, there is provided a tubular heat exchanger wherein a central tube is employed to enclose an internal heated fluid which ascends inside the central tube. The heated fluid is then radially disbursed as it converges toward the internal surface of a top cover of the heat exchanger assembly, being forced outwardly under the top flange by the updraft force of the heated fluid, which forces the heated fluid downwardly apportioning the heated fluid around equally spaced axially arranged heat transfer tubes surrounded by an outer tube which are in sealed engagement with the top flange and attach at the bottom in sealing engagement with the exhaust collection manifold. The heated fluid descends around the tubes and enters an exhaust manifold exiting through an exhaust pipe. The heat transfer fluid enters a lower plenum and flows around the heat exchanger core into an upper plenum.

8 Claims, 8 Drawing Sheets

CYLINDRICAL TUBULAR HEAT EXCHANGER TYPE 2

FIELD OF THE INVENTION

The present invention relates to heat exchangers and, more particularly, to concentric tubular heat exchangers enclosing an ascending central heat source with a radially arranged heat exchange tube configuration inside the outer tube periphery.

BACKGROUND OF THE INVENTION

In the field of heat exchangers, several problems have arisen with some of the present designs. The biggest problem with virtually all heat exchangers is the lack of serviceability due to their rigid welded construction, preventing disassembly necessary to clean residual combustion byproducts from the internal surfaces of such heat exchangers. Additionally, the heat exchanger is generally located somewhat remotely from the heat source allowing a certain amount heat loss, depending on the particular design of the furnace.

In the field of heat exchangers, a need has arisen for a heat exchanger that is easily serviceable as well as extremely efficient. A major drawback of conventional heat exchangers is a lack of serviceability due to their rigid welded construction, preventing internal accessibility which is necessary to clean residual combustion byproducts from the internal surfaces of such heat exchangers. Additionally, conventional heat exchangers are generally located remotely from the heat source due to their enclosed configurations, which can allow for a loss of heat.

Most heat exchangers are mechanically welded and not conducive to disassembly and cleaning, reducing overall efficiency gradually throughout the life of the unit, which is particularly disadvantageous when used in conjunction with solid fuel and bio-mass type fuels which generally produce more combustion byproducts than liquid and gaseous fuels.

Conventional heat exchangers generally don't enclose the entire heat source resulting in greater heat loss.

Conventional heat exchangers generally require more space than the present invention for an equivalent amount of heat exchange.

It is thus a primary object of the present invention to provide a novel tubular heat exchanger.

It is further an object of the present invention to provide such a novel tubular heat exchanger which is of simple construction.

It is further an object of the present invention to provide such a novel tubular heat exchanger which can be quickly and easily internally accessed to facilitate convenient cleaning of the internal surfaces of the heat exchanger.

It is further an object of the present invention to provide such a novel tubular heat exchanger which is small in size, relatively inexpensive, and extremely efficient in its operation.

It is further an object of the present invention to provide such a novel tubular heat exchanger of an optimum design which surrounds and encloses a centrally located heat source.

It is further an object of the present invention to provide such a novel tubular heat exchanger design that can be easily expanded to increase the amount of heat exchange area by merely lengthening the tubular components.

SUMMARY OF THE INVENTION

In accordance with the present invention, there is provided a tubular heat exchanger wherein a central tube is employed to enclose an ascending internal heated fluid. The heated fluid is radially disbursed as it converges toward the internal surface of the top cover of the heat exchanger assembly. The heated fluid is forced outwardly below the top flange of the top cover assembly by the updraft flow of the heated fluid, which thereby forces the heated fluid downwardly, apportioning the heated fluid around radially spaced axially arranged heat exchange tubes which are inside of an outer tube, both of which are in sealed engagement with the annular flange of the top cover assembly. The heat exchange tubes concentrically surround the central tube of the heat exchanger assembly and attach at the bottom in sealing engagement with the bottom of the exhaust collection manifold. The heated fluid descends around the heat exchange tubes, gradually disbursing heat inwardly through the walls of the heat exchange tubes. The mostly cooled heated fluid is then collected and recombined below in the exhaust collection manifold which is attached in sealing relation with the exhaust outlet pipe or pipes which vents the mostly spent heated fluid into the atmosphere.

The heat transfer fluid is forced or drawn by mechanical means or other methods of draft induction into the space inside a lower plenum under the bottom of the exhaust collection manifold and a portion of it is forced or drawn into the equally spaced radially arranged heat transfer tubes which extend from the bottom of the exhaust collection manifold to the top of the annular top flange. As the heat transfer fluid ascends inside the heat exchanger tubes, it is gradually heated by the heat transferred from the descending heated fluid outside the heat transfer tubes, which heat is conducted through the walls of the heat exchange tubes. As the heat transfer fluid ascends toward the annular top flange, it is forced upwardly out of the heat exchange tubes to be recollected in the upper plenum which encompasses the top of the heat exchanger adjacent to the top cover from which additional heat is transferred into the heat transfer fluid. The now fully heated internal portion of the heat transfer fluid continues ascending into an upper plenum.

Additionally, another heat exchange function will be occurring simultaneously beginning with the heat transfer fluid entering the lower plenum below the exhaust collection manifold, wherein some of the heat transfer fluid will be directed around the outer surface of the exhaust collection manifold conducting some of the residual heat still remaining in the heated fluid inside the exhaust collection manifold as it recombines and exits the system from the exhaust collection manifold into the connected exhaust pipe. This outer portion of the heat transfer fluid initially ascends upwardly around the sides of the exhaust collection manifold and then is directed inwardly by an outer heat shield towards the outer tube of the heat exchanger. The heat exchange fluid then ascends vertically in the space surrounding the outer tube of the heat exchanger inside the cylindrical section of the outer heat shield which is radially spaced from the outer tube of the heat exchanger to provide an annular cavity between the outside of the outer tube of the heat exchanger and between the inside of the cylindrical section of the heat shield. As this outer portion of the heat exchange fluid ascends in the space provided between the outer tube of the heat exchanger and the cylindrical section of the heat shield, the heat exchange fluid is increasingly heated by the descending heated fluid inside the outer tube of the heat exchanger. As the outer portion of the heat transfer fluid ascends past the annular top flange which is connected to the outer tube of the heat exchanger, being fully heated, it then exits into the upper plenum area above the top cover of the heat exchanger to be recombined with the inner portion of the heat exchange fluid which is exiting upwardly out of the inside of the heat exchanger tubes for utilization in a heating system.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
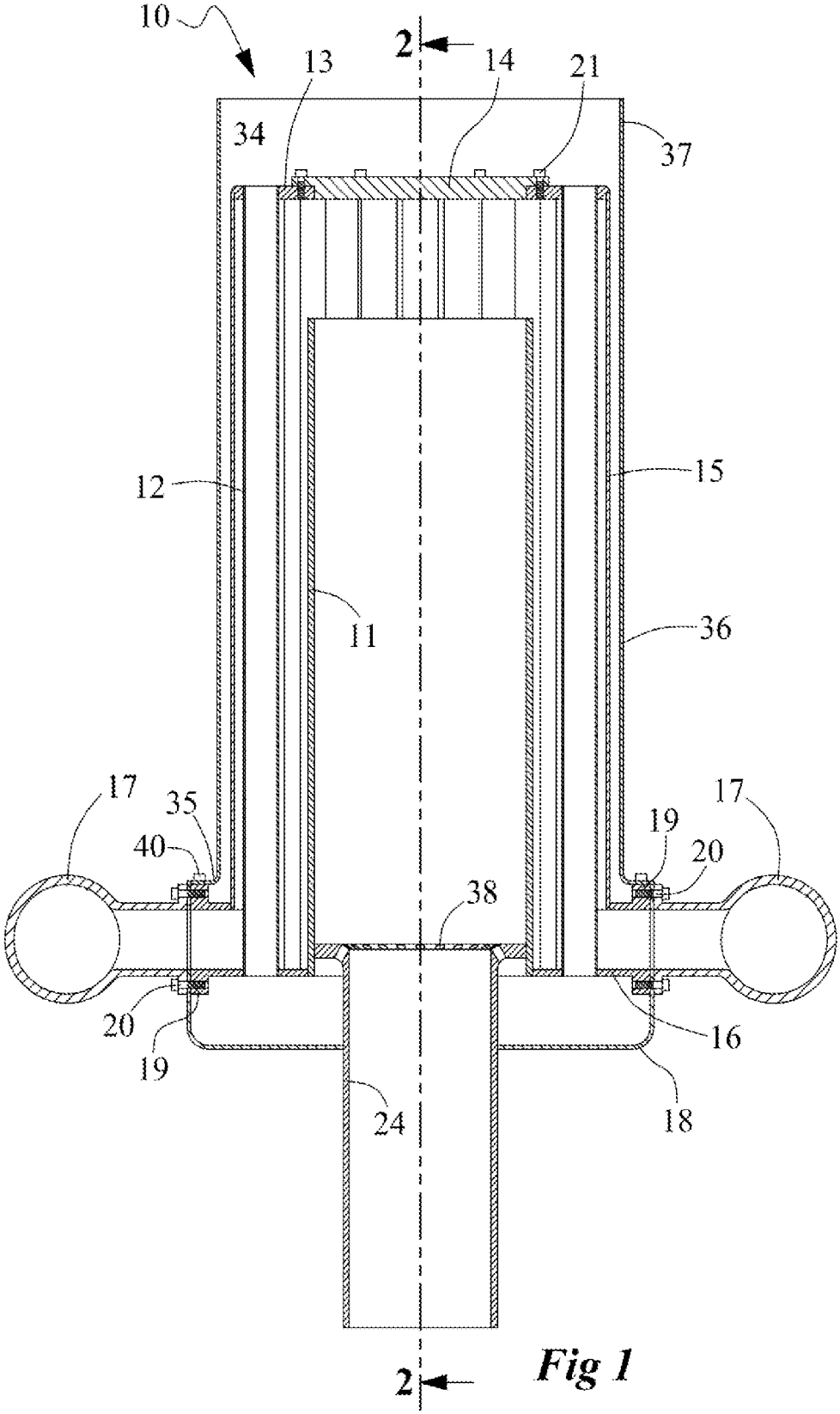
FIG. 1 is a longitudinal cross sectional view of a tubular heat exchanger assembly according to the teachings of the present invention.

In accordance with the teachings of the present invention, there is shown in the drawings a heat exchanger assembly, generally designated 10. There is provided a tubular heat exchanger assembly wherein a central tube 11 is attached securely in rigid sealing engagement with the bottom of an exhaust collection manifold 16 assembly. The exhaust collection manifold 16 assembly is also is connected in sealing engagement via its end flanges 19 with the exhaust outlet pipes 17 and the lower plenum 18 by a series of spaced screws 20. Arranged in equally spaced configuration and in press fit side sealing engagement with the removable top flange 13 and also with the bottom of the exhaust collection manifold 16 are twenty-four radially spaced axially arranged heat exchange tubes 12. Also attached in face sealing relation to the removable top flange 13 by a series of radially spaced screws 21 is the removable top cover 14. The outer periphery of the removable top flange 13 is connected in sealing relation with the top of the outer tube 15. The bottom of the outer tube 15 is connected in rigid sealing relation with the top of the exhaust collection manifold 16. Surrounding the outer tube 15 of the heat exchanger core assembly is the outer heat shield 34 which is attached by its lower flange 35 to the tops of the end flanges 19 of the exhaust collection manifold 16 by a group of four fasteners 40. Also attached below the exhaust collection manifold 16 assembly to the end flanges 19 thereof by a series of spaced screws 20 is the lower plenum 18. The outer heat shield 34 assembly is spaced above the top of the exhaust collection manifold 16 and outwardly from the outer tube 15 to provide an external fluid flow path from the lower plenum 18 around and above the exhaust collection manifold 16 into the space between the cylindrical upper section of the outer heat shield 34 and the outer tube 15 of the heat exchanger core. This flow path then ascends into the upper plenum region 37 of the outer heat shield 34 assembly.

The basic embodiment of the heat exchanger assembly provides for a continuous internal flow passage for a heated fluid from above the separator plate 27 of the central tube 11, ascending vertically inside the central tube 11 to the space underneath the removable top cover 14 wherein the heated fluid is disbursed outwardly below the removable top flange 13 then descending axially around the heat exchange tubes 12 and from there flowing into the exhaust collection manifold 16 assembly and after that into the exhaust outlet pipes 17 and finally venting into the atmosphere. This internal flow path is sealed from the external areas around these core components allowing only the heat to be transferred by conduction through the walls of the components, particularly the heat exchange tubes 12, into the internally and externally flowing heat transfer fluid flowing internally through the heat exchange tubes 12 and also externally around the outsides of the outer tube 15, generally flowing in a direction opposite of the internal flow of the heated fluid. This heat transfer fluid is most often external air forced or drawn into the internal cavity of the lower plenum 18 by mechanical means such as a fan or fans or by convection draft. As previously stated, the heat transfer fluid basically flows in an external flow path around the heat exchanger core in a direction opposite from the flow direction of the internal heated fluid, which is the optimum flow relationship for the most efficient heat transfer.

Thus the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the present description as well as the appended claims, and all changes which come within the meaning and range of equivalency of the claims are intended to be embraced therein.

In accordance with the present invention, there is provided a tubular heat exchanger wherein a central tube 11 is employed to enclose an internal heated fluid which ascends inside the aforementioned central tube 11. The heated fluid is then radially disbursed as it ascends toward the internal surface of the top cover 14 assembly of the heat exchanger assembly. The heated fluid is then forced or drawn outwardly to the internal space under the removable top flange 13 by the updraft flow of the heated fluid, which thereby forces the heated fluid downwardly into the space outside of the central tube 11 and inside of the outer tube 15, apportioning the heated fluid around equally radially spaced axially arranged heat exchange tubes 12 which are in sealed engagement with the annular removable top flange 13 of the top cover 14 assembly to which connected to the top cover 14 in sealed engagement by a series of radially spaced screws 21. The aforementioned heat exchange tubes 12 concentrically surround the central tube 11 of the heat exchanger assembly, radially spaced from the central tube 11, and attach at the bottom in sealing engagement with bottom of the the exhaust collection manifold 16. The heated fluid descends around and through the gaps between the heat exchange tubes 12, gradually transferring heat inwardly through the walls of the heat exchange tubes 12 as it descends. The mostly cooled heated fluid is then collected and recombined below in the exhaust collection manifold 16 which is attached in sealing relation with the outer tube 15 as well as the exhaust outlet pipes 17 from which the mostly spent heated fluid is exhausted into the atmosphere.

The heat transfer fluid is forced or drawn by mechanical means or other methods of draft induction, into the space inside the lower plenum 18 under the bottom of the exhaust collection manifold 16 and is forced or drawn into the bottoms of the radially spaced axially arranged heat exchange tubes 12 which extend from the bottom of the exhaust collection manifold 16 to the top of the annular removable top flange 13 of the top cover 14 assembly. As this inner portion of the heat transfer fluid enters and ascends inside the heat exchange tubes 12, it is gradually heated by the heat transferred from the descending heated fluid outside the heat exchange tubes 12 which is conducted inwardly through the walls of the heat exchange tubes 12. As the heat transfer fluid ascends inside the heat exchange tubes 12 towards the annular removable top flange 13, it is forced or drawn upwardly out of the heat exchange tubes 12 to be collected and recombined in the upper plenum region 37 of the outer heat shield 34 which encompasses the top of the heat exchanger adjacent to the top cover 14 assembly, drawing even more heat radiating from the top cover 14 assembly, from which the now fully heated internal portion of the heat transfer fluid continues ascending into the upper plenum region 37 of the outer heat shield 34.

Additionally, another heat exchange function will be occurring simultaneously beginning with the heat transfer fluid entering the lower plenum 18 below the exhaust collection manifold 16 wherein the outer portion of the heat transfer fluid will be directed around the outer surfaces of the exhaust collection manifold 16 conducting some of the residual heat still remaining in the mostly spent heated fluid as it recombines and exits the exhaust collection system from the exhaust collection manifold 16 into the connected exhaust pipe. This aforementioned outer portion of the heat transfer fluid initially ascends upwardly around the outsides of the exhaust collection manifold 16, within the plenum, and then is directed inwardly by the lower flanged section of the outer heat shield 34 towards the outer tube 15 of the heat exchanger core. The heat exchange fluid then ascends axially in the annular space surrounding the outer tube 15 of the heat exchanger core inside the cylindrical section 36 of the outer heat shield 34 which is radially spaced outwardly from the outer tube 15 of the heat exchanger to provide an annular space between the outside of the outer tube 15 of the heat exchanger core and between the inside of the cylindrical section 36 of the outer heat shield 34. As the aforementioned external portion of the heat exchange fluid ascends in this space provided between the outer tube 15 of the heat exchanger core and the cylindrical section 36 of the outer heat shield 34, the heat transfer fluid is increasingly heated by the descending heated fluid inside the outer tube 15 of the heat exchanger conducting heat outwardly through the wall of the outer tube 15. As the external portion of heat transfer fluid ascends past the annular removable top flange 13 of the top cover 14 assembly, being sufficiently heated, it then enters into the upper plenum region 37 of the outer heat shield 34 above of the heat exchanger core to be recombined with the internal portion of the heat exchange fluid which is exiting upwardly out of the insides of the heat exchanger tubes. This now recombined and fully heated heat exchange fluid ascends out of the upper plenum region 37 of the outer heat shield 34 for utilization in a heating system.

It should be understood that while the preferred embodiment of the present invention utilizes both an inner portion and an outer portion of the heat exchange fluid from the lower plenum 18 to the upper plenum region 37 to optimize efficiency, that either the inner portion or the outer portion of the heat exchange fluid can facilitate a complete heat exchange system by themselves.

The heat exchanger assembly can utilize either an internal or external heat source for the heated fluid, as explained below.

Figure 2:
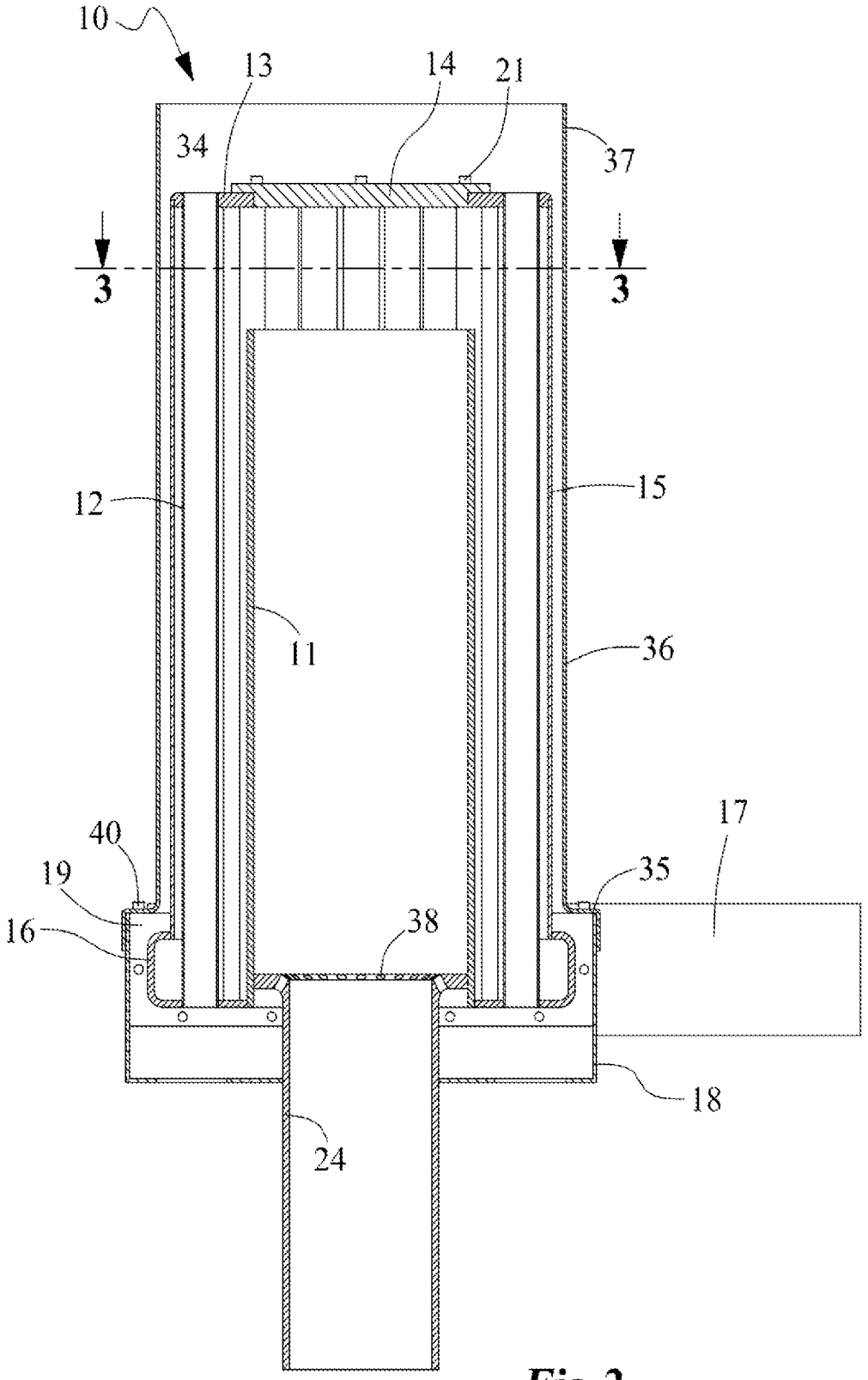
FIG. 2 is a cross sectional view of a heat exchanger assembly of FIG. 1 according to section line 2-2 of FIG. 1.
Figure 3:
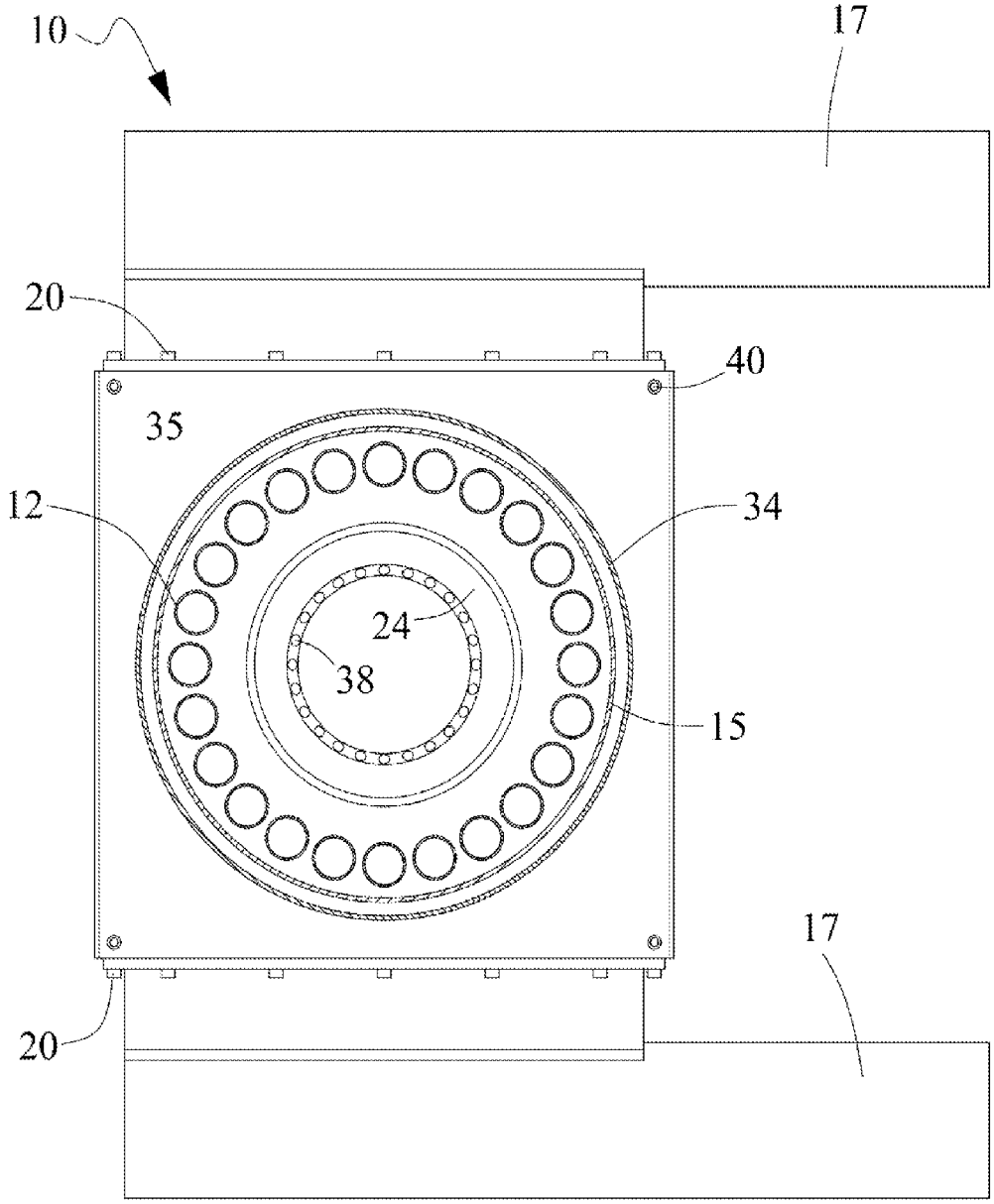
FIG. 3 is a cross sectional view of a heat exchanger assembly of FIG. 1 and FIG. 2 according to 3-3 of FIG. 2.
Figure 4:
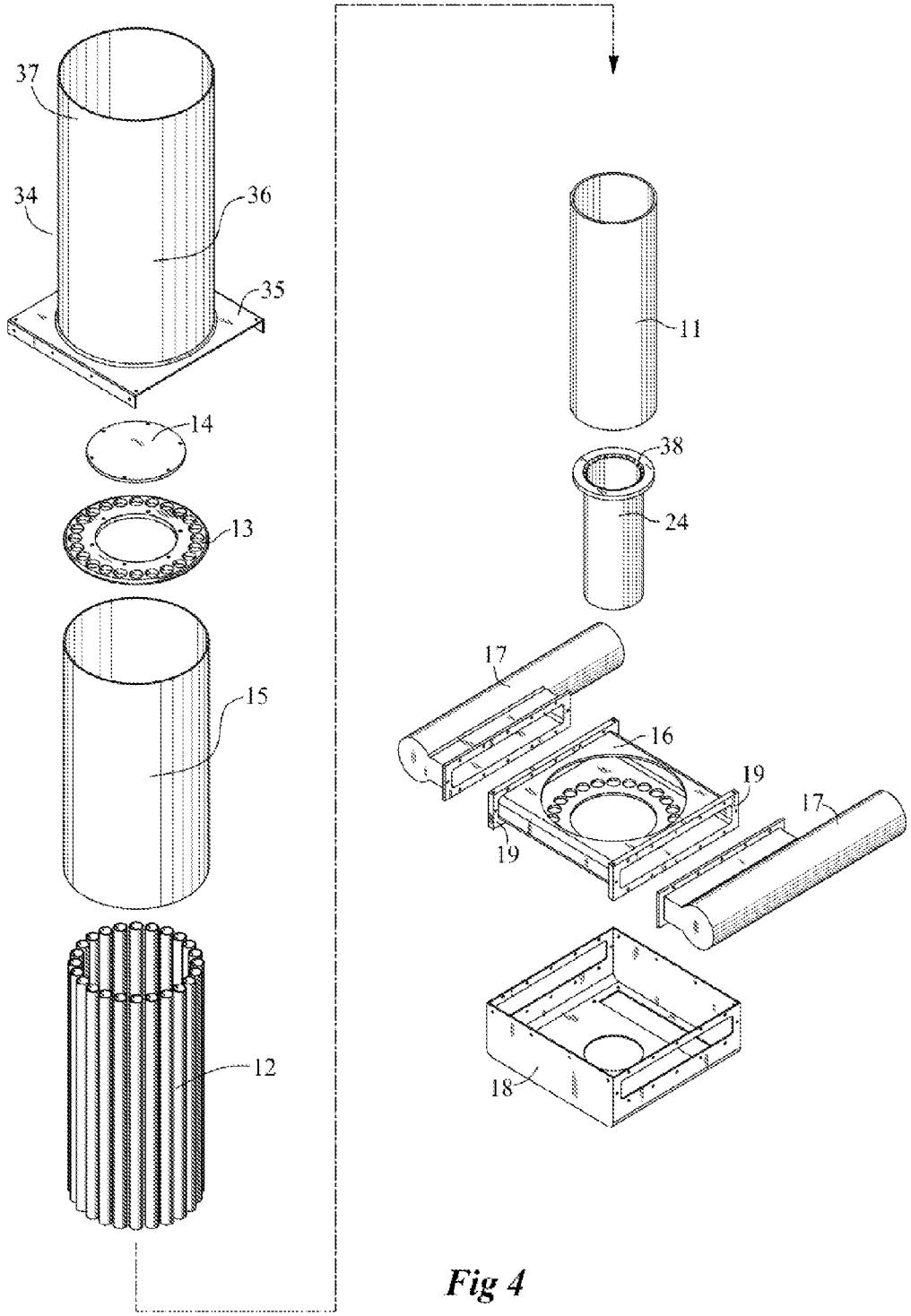
FIG. 4 is an exploded isometric view of an elements depicted in FIG. 1, FIG. 2, and FIG. 3 to enhance the clarity of the relationship of the elements.

As shown in FIGS. 1,2,3,4, an optional inlet pipe 24 can be employed to provide an entrance for heated fluid from an external source such as an external combustor or biofuel gasifier into the central tube 11 through the attached separator plate 27, whereby additional air can be added via the optional air inlet holes 38 in the separator plate 27 to enable a secondary combustion process within the central tube 11 above the separator plate 27, which may or may not require a secondary ignition system, depending on the application. The use of a secondary combustion process in conjunction with biomass type fuels is desirable to promote complete combustion to reduce or eliminate harmful exhaust emissions.

Figure 5:
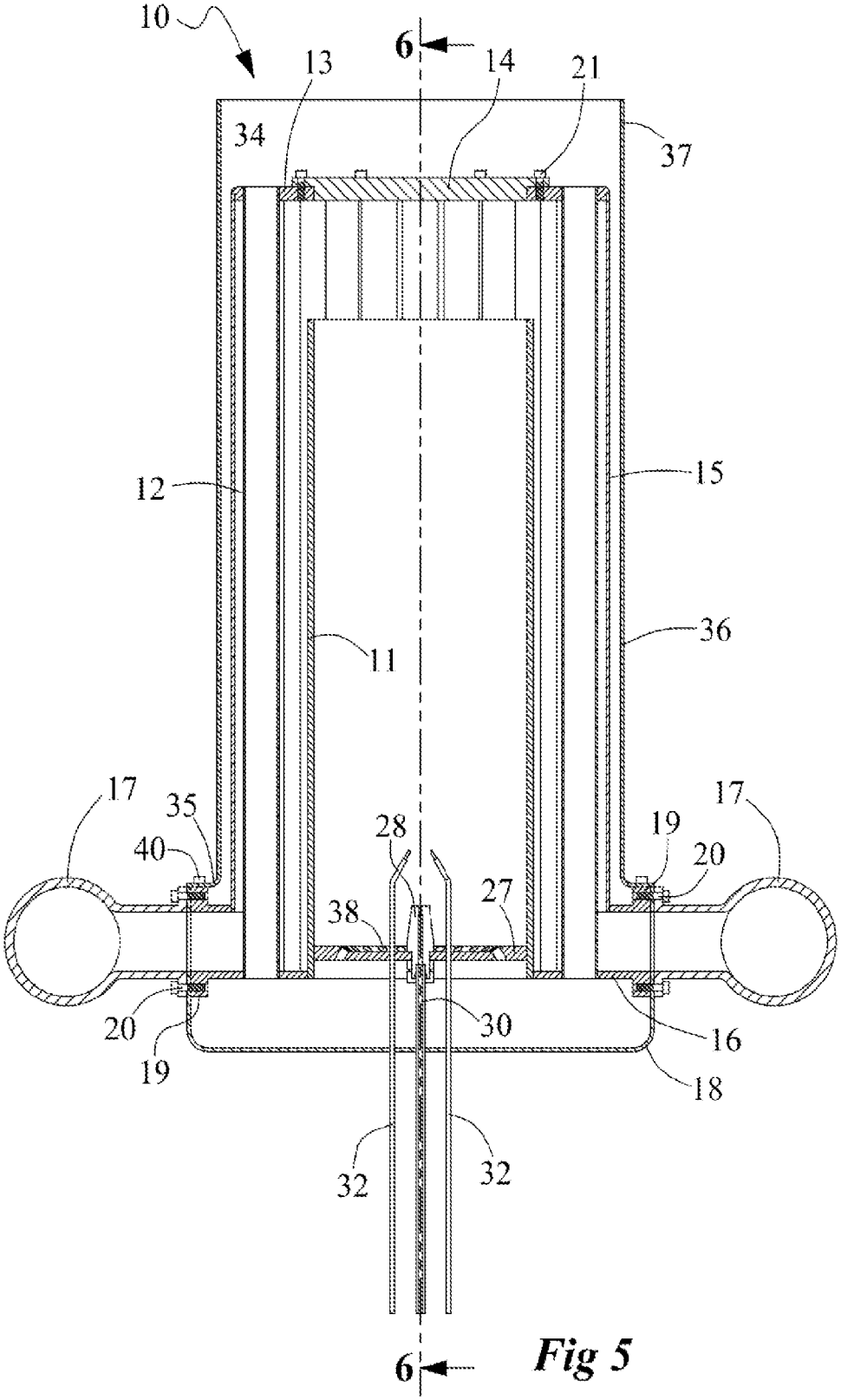
FIG. 5 is a longitudinal cross sectional view of a tubular heat exchanger assembly according to the teachings of the present invention.
Figure 6:
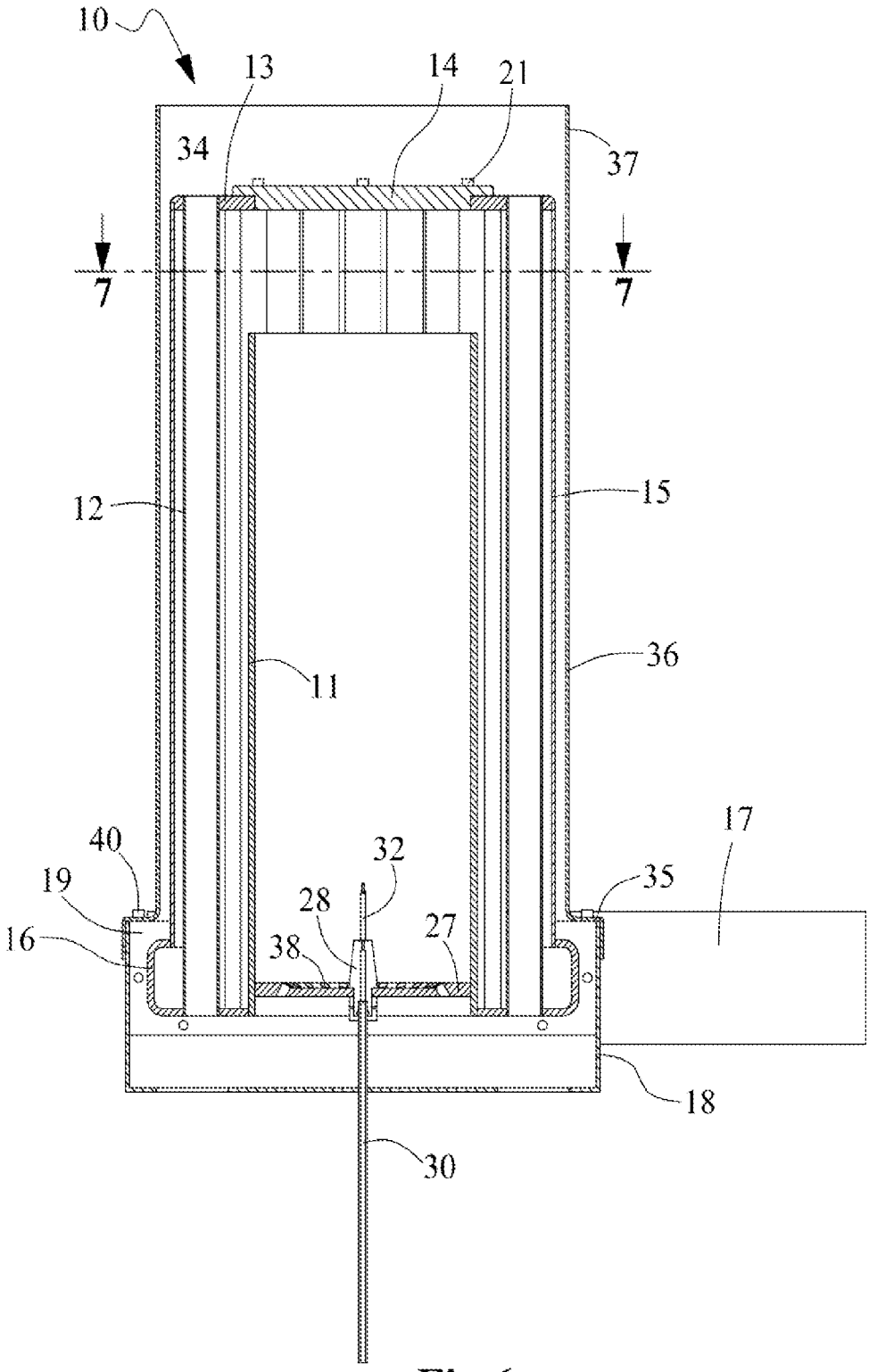
FIG. 6 is a cross sectional view of a heat exchanger assembly of FIG. 5 according to section line 6-6 of FIG. 5.
Figure 7:
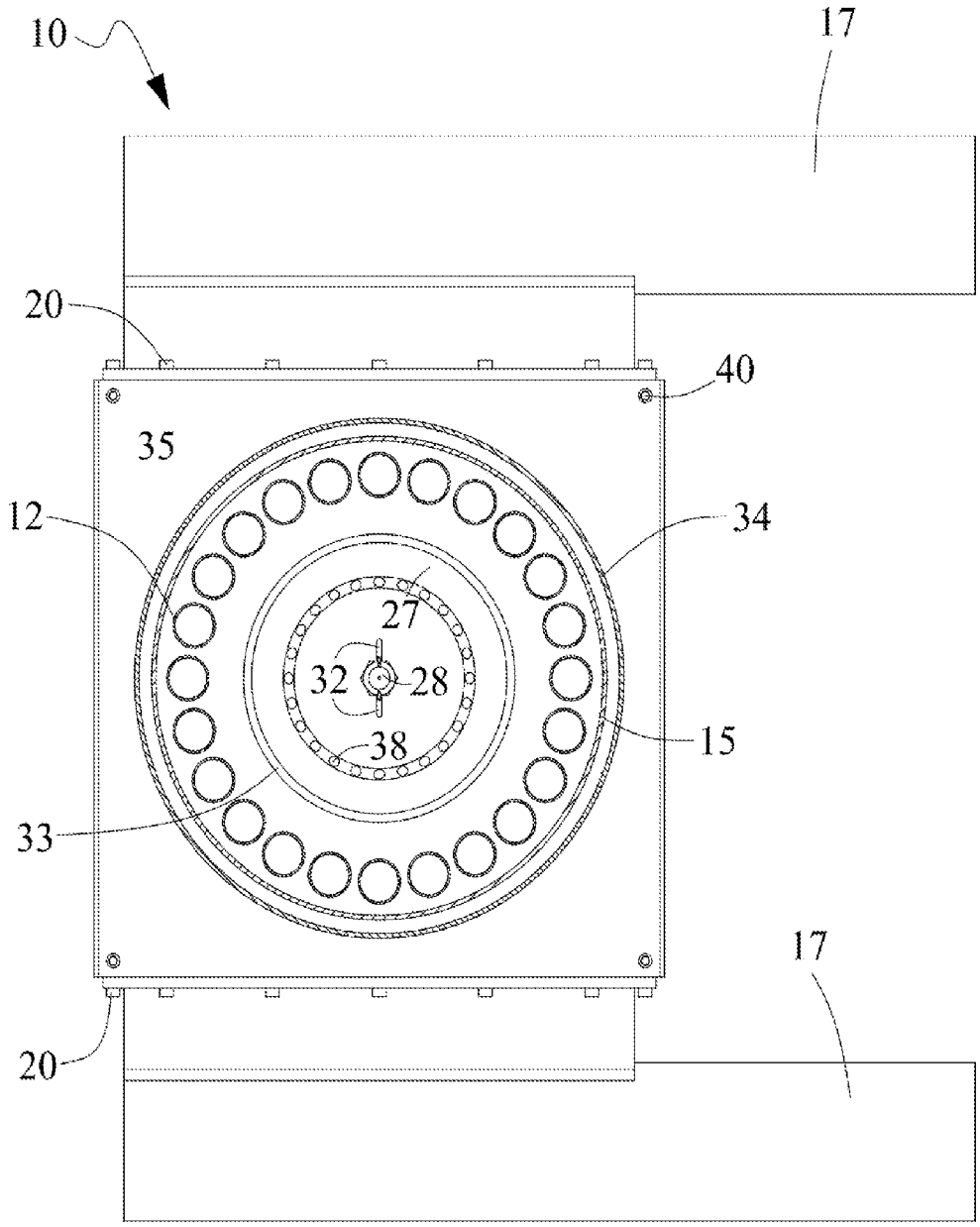
FIG. 7 is a cross sectional view of a heat exchanger assembly of FIG. 5 and FIG. 6 according to 7-7 of FIG. 6.
Figure 8:
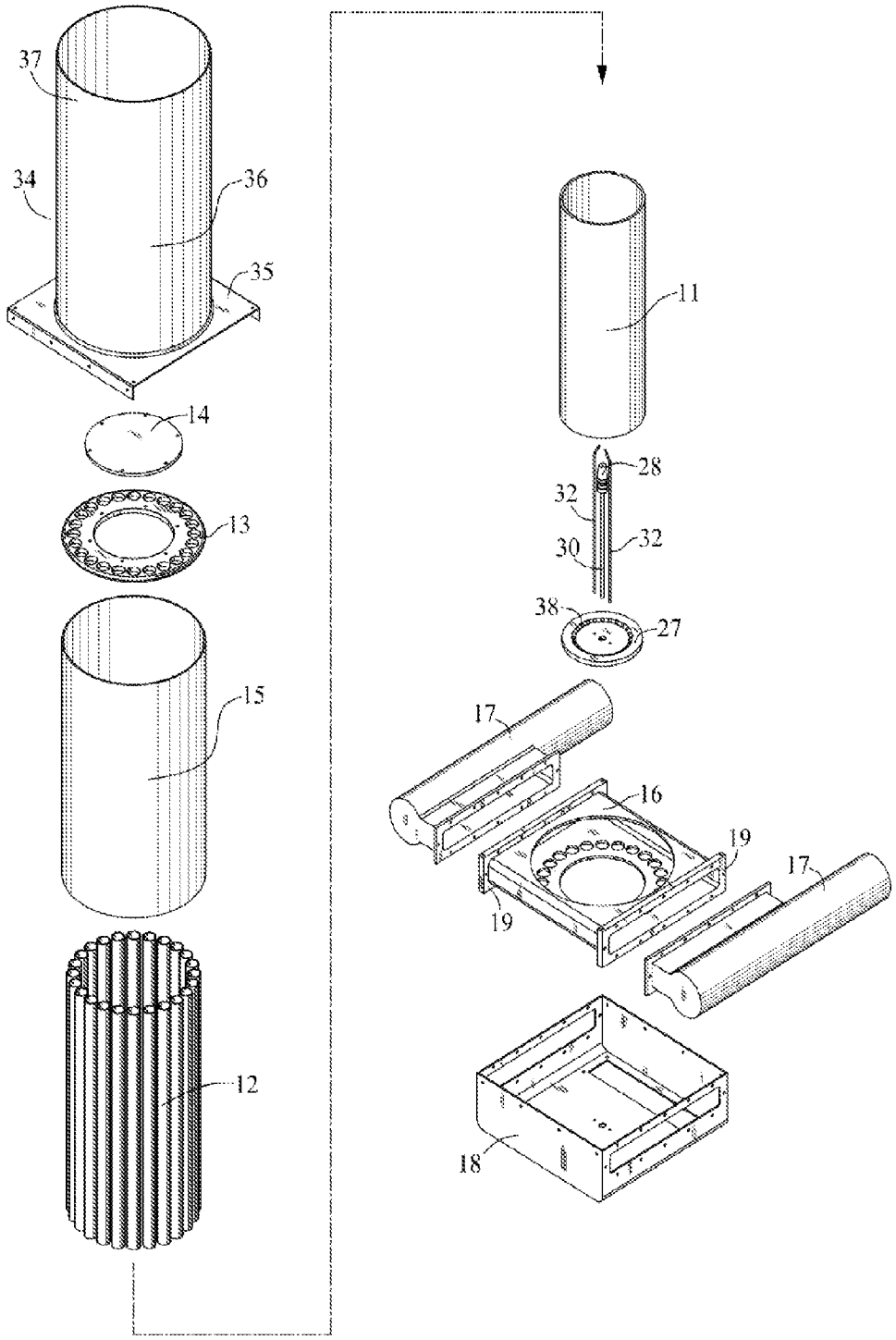
FIG. 8 is an exploded isometric view of an elements depicted in FIG. 5, FIG. 6, and FIG. 7 to enhance the clarity of the relationship of the elements.

Also shown in FIGS. 5, 6, 7, 8 is an optional typical fuel combustion arrangement for the heated fluid source featuring a fuel line 30, fuel nozzle 28, ignition electrodes 32 and combustion air inlet holes 38 extending through the separator plate 27 of the central tube 11 assembly assembly, which, in conjunction with the tubular heat exchanger assembly, essentially form a complete furnace.

The unique design of the present invention provides convenient access to the internal surface areas of the heat exchanger via the removable top cover 14 assembly of the center tube assembly as well as the removable exhaust outlet pipes 17 of the exhaust collection manifold 16 assembly. This convenient internal accessibility allows for simple cleaning of the internal surfaces of the heat exchanger using brushes and various other types of common utensils to remove built up residual combustion byproducts from the internal surfaces of the tubes and other components of the heat exchanger to maintain maximum heat transfer efficiency throughout the life of the unit.

In an embodiment a cylindrical tubular heat exchanger type 2 for more efficient heat exchange and better serviceability comprising: means for encompassing the heat source, combustion area; means for enclosing the ascending inner portion of the heat transfer fluid, transferring heat from the descending heated fluid surrounding the outside of the heat exchange tubes into the ascending heat transfer fluid which is inside the heat exchange tubes via conduction through the tube walls; means for covering and sealing the outer tube, and providing a secondary heat exchange area, the top mounting area for the heat exchange tubes, and a sealable mounting flange for the removable top cover. when removed allows internal access into the outer tube to remove the heat exchange tubes for cleaning, rigidly connected to said means for enclosing the ascending inner portion of the heat transfer fluid, transferring heat from the descending heated fluid surrounding the outside of the heat exchange tubes into the ascending heat transfer fluid which is inside the heat exchange tubes via conduction through the tube walls, and removably connected to said means for encompassing the heat source, combustion area; means for providing a sealable cover and an initial heat exchange area mounted to the top flange which allows access to internal surfaces when removed, sealably fastened to said means for covering and sealing the outer tube, and providing a secondary heat exchange area, the top mounting area for the heat exchange tubes, and a sealable mounting flange for the removable top cover when removed allows internal access into the outer tube to remove the heat exchange tubes for cleaning; means for enclosing the internal heat exchange area around the heat exchange tubes, as well providing an additional heat exchange area on its outer surface. Also a connecting link between the removable top flange and the exhaust collection manifold, rigidly connected to said means for covering and sealing the outer tube, and providing a secondary heat exchange area, the top mounting area for the heat exchange tubes, and a sealable mounting flange for the removable top cover. when removed allows internal access into the outer tube to remove the heat exchange tubes for cleaning; means for collecting and recombining the spent heated fluid exiting the heat exchange tubes and directing the spent heated fluid into the exhaust outlet pipe, rigidly connected to said means for enclosing the internal heat exchange area around the heat exchange tubes, as well providing an additional heat exchange area on its outer surface. also a connecting link between the removable top flange and the exhaust collection manifold, rigidly connected to said means for enclosing the ascending inner portion of the heat transfer fluid, transferring heat from the descending heated fluid surrounding the outside of the heat exchange tubes into the ascending heat transfer fluid which is inside the heat exchange tubes via conduction through the tube walls, and rigidly connected to said means for encompassing the heat source, combustion area; means for venting spent heated fluid, normally combustion exhaust gases, from the exhaust collection manifold into the atmosphere, rigidly connected to said means for collecting and recombining the spent heated fluid exiting the heat exchange tubes and directing the spent heated fluid into the exhaust outlet pipe; means for enclosing a space under the exhaust collection manifold for distributing the incoming air or other medium to be utilized as a heat transfer fluid, rigidly fastened to said means for venting spent heated fluid, normally combustion exhaust gases, from the exhaust collection manifold into the atmosphere; means for connecting exhaust collection manifold to exhaust outlet pipes and lower plenum as well as to the lower flange portion of the outer heat shield assembly, rigidly fastened to said means for enclosing a space under the exhaust collection manifold for distributing the incoming air or other medium to be utilized as a heat transfer fluid, rigidly fastened to said means for venting spent heated fluid, normally combustion exhaust gases, from the exhaust collection manifold into the atmosphere, and rigidly connected to said means for collecting and recombining the spent heated fluid exiting the heat exchange tubes and directing the spent heated fluid into the exhaust outlet pipe; means for attaching the top cover to the removable top flange, rigidly connected to said means for providing a sealable cover and an initial heat exchange area mounted to the top flange which allows access to internal surfaces when removed, and rigidly connected to said means for covering and sealing the outer tube, and providing a secondary heat exchange area, the top mounting area for the heat exchange tubes, and a sealable mounting flange for the removable top cover when removed allows internal access into the outer tube to remove the heat exchange tubes for cleaning; means for separating the bottom of the central tube from the lower plenum, mounting optional fuel nozzle and ignition electrodes or inlet pipe, and provides for air inlet holes for combustion air; means for providing an inlet passage for external combustion or gasifier fluid into bottom of the central tube through the separator plate, rigidly connected to said means for enclosing a space under the exhaust collection manifold for distributing the incoming air or other medium to be utilized as a heat transfer fluid, and rigidly connected to said means for incoming air or other medium to be utilized as a heat transfer fluid, rigidly fastened to said means for venting spent heated fluid, normally combustion exhaust gases, from the exhaust collection manifold into the atmosphere; means for connecting exhaust collection manifold to exhaust outlet pipes and lower plenum as well as to the lower flange portion of the outer heat shield assembly, rigidly fastened to said means for enclosing a space under the exhaust collection manifold for distributing the incoming air or other medium to be utilized as a heat transfer fluid, rigidly fastened to said means for venting spent heated fluid, normally combustion exhaust gases, from the exhaust collection manifold into the atmosphere, and rigidly connected to said means for collecting and recombining the spent heated fluid exiting the heat exchange tubes and directing the spent heated fluid into the exhaust outlet pipe; means for attaching the top cover to the removable top flange, rigidly connected to said means for providing a sealable cover and an initial heat exchange area mounted to the top flange which allows access to internal surfaces when removed, and rigidly connected to said means for covering and sealing the outer tube, and providing a secondary heat exchange area, the top mounting area for the heat exchange tubes, and a sealable mounting flange for the removable top cover when removed allows internal access into the outer tube to remove the heat exchange tubes for cleaning; means for separating the bottom of the central tube from the lower plenum, mounting optional fuel nozzle and ignition electrodes or inlet pipe, and provides for air inlet holes for combustion air; means for providing an inlet passage for external combustion or gasifier fluid into bottom of the central tube through the separator plate, rigidly connected to said means for enclosing a space under the exhaust collection manifold for distributing the incoming air or other medium to be utilized as a heat transfer fluid, and rigidly connected to said means for encompassing the heat source, combustion area; means for concentrically enclosing the area around the outer tube which provides an annular internal space for the ascending heat transfer fluid while minimizing heat loss; means for attaching the exhaust outlet pipes to the end flanges and the lower plenum, rigidly connected to said means for connecting exhaust collection manifold to exhaust outlet pipes and lower plenum as well as to the lower flange portion of the outer heat shield assembly, rigidly connected to said means for enclosing a space under the exhaust collection manifold for distributing the incoming air or other medium to be utilized as a heat transfer fluid, and rigidly connected to said means for venting spent heated fluid, normally combustion exhaust gases, from the exhaust collection manifold into the atmosphere; means for enclosing and directing the outer portion of the heat exchange fluid from the lower plenum, around the exhaust collection manifold, and into the space between the outer tube and outer heat shield, rigidly connected to said means for concentrically enclosing the area around the outer tube which provides an annular internal space for the ascending heat transfer fluid while minimizing heat loss, rigidly fastened to said means for connecting exhaust collection manifold to exhaust outlet pipes and lower plenum as well as to the lower flange portion of the outer heat shield assembly, and rigidly connected to said means for enclosing a space under the exhaust collection manifold for distributing the incoming air or other medium to be utilized as a heat transfer fluid; means for enclosing the flow path around the exhaust collection manifold, the outer tube, the top flange, and the top cover to prevent heat loss, rigidly connected to said means for enclosing and directing the outer portion of the heat exchange fluid from the lower plenum, around the exhaust collection manifold, and into the space between the outer tube and outer heat shield, and rigidly connected to said means for concentrically enclosing the area around the outer tube which provides an annular internal space for the ascending heat transfer fluid while minimizing heat loss; means for final heat exchange space and recombining the internal and external portions of the exiting heat exchange fluid, rigidly connected to said means for enclosing the flow path around the exhaust collection manifold, the outer tube, the top flange, and the top cover to prevent heat loss, and rigidly connected to said means for concentrically enclosing the area around the outer tube which provides an annular internal space for the ascending heat transfer fluid while minimizing heat loss; means for initiating updraft in the central tube and/or providing inlet air for the fuel mixture to be burned in the optional combustion process, angularly encircling to said means for providing an inlet passage for external combustion or gasifier fluid into bottom of the central tube through the separator plate; and means for fastening the lower flange portion of the outer heat shield assembly to the top of the end flanges of the exhaust collection manifold, rigidly connected to said means for enclosing and directing the outer portion of the heat exchange fluid from the lower plenum, around the exhaust collection manifold, and into the space between the outer tube and outer heat shield, and rigidly connected to said means for connecting exhaust collection manifold to exhaust outlet pipes and lower plenum as well as to the lower flange portion of the outer heat shield assembly.

In an embodiment said means for encompassing the heat source, combustion area comprises an optional element to enhance draft, combustion area central tube. In an embodiment said means for enclosing the ascending inner portion of the heat transfer fluid, transferring heat from the descending heated fluid surrounding the outside of the heat exchange tubes into the ascending heat transfer fluid which is inside the heat exchange tubes via conduction through the tube walls comprises a principle heat exchange component heat exchange tubes.

In an embodiment said means for covering and sealing the outer tube, and providing a secondary heat exchange area, the top mounting area for the heat exchange tubes, and a sealable mounting flange for the removable top cover when removed allows internal access into the outer tube to remove the heat exchange tubes for cleaning comprises an additional heat exchange area, provides internal access into the central tube, allows removal of heat exchange tubes for cleaning removable top flange.

In an embodiment said means for providing a sealable cover and an initial heat exchange area mounted to the top flange which allows access to internal surfaces when removed comprises an internal access top cover.

In an embodiment said means for enclosing the internal heat exchange area around the heat exchange tubes, as well providing an additional heat exchange area on its outer surface. Also a connecting link between the removable top flange and the exhaust collection manifold comprises an additional heat exchange area outer tube. In an embodiment said means for collecting and recombining the spent heated fluid exiting the heat exchange tubes and directing the spent heated fluid into the exhaust outlet pipe comprises a bottom attachment for center tube, lower attachment for outer tube, fixed link base, initial heat exchange area exhaust collection manifold.

In an embodiment said means for venting spent heated fluid, normally combustion exhaust gases, from the exhaust collection manifold into the atmosphere. comprises a complete fluid circuit for heated fluid exhaust outlet pipes.

In an embodiment said means for enclosing a space under the exhaust collection manifold for distributing the incoming air or other medium to be utilized as a heat transfer fluid comprises a lower enclosure lower plenum.

In an embodiment said means for connecting exhaust collection manifold to exhaust outlet pipes and lower plenum as well as to the lower flange portion of the outer heat shield assembly comprises a mounting for exhaust outlet pipes, mounting for lower plenum, mounting for outer heat shield end flanges.

In an embodiment said means for attaching the top cover to the removable top flange comprises securing the top cover using radially spaced screws.

In an embodiment said means for separating the bottom of the central tube from the lower plenum, mounting optional fuel nozzle and ignition electrodes or inlet pipe, and provides for air inlet holes for combustion air comprises and allows for optional air inlet holes in the separator plate.

In an embodiment said means for providing an inlet passage for external combustion or gasifier fluid into bottom of the central tube through the separator plate comprises an allows use of external combustion, allows use of external gasifier optional inlet pipe.

In an embodiment said means for concentrically enclosing the area around the outer tube which provides an annular internal space for the ascending heat transfer fluid while minimizing heat loss comprises an increases heat exchange efficiency outer heat shield.

In an embodiment said means for attaching the exhaust outlet pipes to the end flanges and the lower plenum comprises an exhaust outlet pipes spaced screws.

In an embodiment said means for enclosing and directing the outer portion of the heat exchange fluid from the lower plenum, around the exhaust collection manifold, and into the space between the outer tube and outer heat shield comprises an increases efficiency, connecting link for outer heat shield lower flange.

In an embodiment said means for enclosing the flow path around the exhaust collection manifold, the outer tube, the top flange, and the top cover to prevent heat loss comprises a contains heat transfer fluid, reduces heat loss cylindrical section. In an embodiment said means for final heat exchange space and recombining the internal and external portions of the exiting heat exchange fluid comprises a recombines heat exchange fluid, exit for heat exchange fluid upper plenum region.

In an embodiment said means for fastening the lower flange portion of the outer heat shield assembly to the top of the end flanges of the exhaust collection manifold comprises a secures outer heat shield assembly group of four fasteners.

In an embodiment for more efficient heat exchange and better serviceability comprising: an optional element to enhance draft, combustion area central tube, for encompassing the heat source, combustion area; a principle heat exchange component heat exchange tubes, for enclosing the ascending inner portion of the heat transfer fluid, transferring heat from the descending heated fluid surrounding the outside of the heat exchange tubes into the ascending heat transfer fluid which is inside the heat exchange tubes via conduction through the tube walls; an additional heat exchange area, provides internal access into the central tube, allows removal of heat exchange tubes for cleaning removable top flange, for covering and sealing the outer tube, and providing a secondary heat exchange area, the top mounting area for the heat exchange tubes, and a sealable mounting flange for the removable top cover which when removed allows internal access into the outer tube to remove the heat exchange tubes for cleaning, rigidly connected to said heat exchange tubes, and removably connected to said central tube; a provides internal access top cover, for providing a sealable cover and an initial heat exchange area mounted to the top flange which allows access to internal surfaces when removed, sealably fastened to said removable top flange; an additional heat exchange area. outer tube, for enclosing the internal heat exchange area around the heat exchange tubes, as well providing an additional heat exchange area on its outer surface. also a connecting link between the removable top flange and the exhaust collection manifold, rigidly connected to said removable top flange; a bottom attachment for center tube, lower attachment for outer tube, fixed link base, initial heat exchange area exhaust collection manifold, for collecting and recombining the spent heated fluid exiting the heat exchange tubes and directing the spent heated fluid into the exhaust outlet pipe, rigidly connected to said outer tube, rigidly connected to said heat exchange tubes, and rigidly connected to said central tube; a completes fluid circuit for heated fluid exhaust outlet pipes, for venting spent heated fluid, normally combustion exhaust gases, from the exhaust collection manifold into the atmosphere, rigidly connected to said exhaust collection manifold; a Lower enclosure lower plenum, for enclosing a space under the exhaust collection manifold for distributing the incoming air or other medium to be utilized as a heat transfer fluid, rigidly fastened to said exhaust outlet pipes; a mounting for exhaust outlet pipes, mounting for lower plenum, mounting for outer heat shield end flanges, for connecting exhaust collection manifold to exhaust outlet pipes and lower plenum as well as to the lower flange portion of the outer heat shield assembly, rigidly fastened to said lower plenum, rigidly fastened to said exhaust outlet pipes, and rigidly connected to said exhaust collection manifold; a secures top cover radially spaced screws, for attaching the top cover to the removable top flange, rigidly connected to said top cover, and rigidly connected to said removable top flange; allows for optional air inlet holes and separator plate for separating the bottom of the central tube from the lower plenum, mounting optional fuel nozzle and ignition electrodes or inlet pipe, and provides for air inlet holes for combustion air; an allows use of external combustion, allows use of external gasifier optional inlet pipe, for providing an inlet passage for external combustion or gasifier fluid into bottom of the central tube through the separator plate, rigidly connected to said lower plenum, and rigidly connected to said central tube; a heat exchange efficiency increasing outer heat shield, for concentrically enclosing the area around the outer tube which provides an annular internal space for the ascending heat transfer fluid while minimizing heat loss; a secures exhaust outlet pipes spaced screws, for attaching the exhaust outlet pipes to the end flanges and the lower plenum, rigidly connected to said end flanges, rigidly connected to said lower plenum, and rigidly connected to said exhaust outlet pipes; an increases efficiency, connecting link for outer heat shield lower flange, for enclosing and directing the outer portion of the heat exchange fluid from the lower plenum, around the exhaust collection manifold, and into the space between the outer tube and outer heat shield, rigidly connected to said outer heat shield, rigidly fastened to said end flanges, and rigidly connected to said lower plenum; a contains heat transfer fluid, reduces heat loss cylindrical section, for enclosing the flow path around the exhaust collection manifold, the outer tube, the top flange, and the top cover to prevent heat loss, rigidly connected to said lower flange, and rigidly connected to said outer heat shield; an exit for heat exchange fluid recombining in the upper plenum region for final heat exchange, space and recombining the internal and external portions of the exiting heat exchange fluid, rigidly connected to said cylindrical section, and rigidly connected to said outer heat shield; and an initial draft means in center tube, enabling combustion above separator plate air inlet holes, for initiating updraft in the central tube and/or providing inlet air for the fuel mixture to be burned in the optional combustion process, angularly encircling to said optional inlet pipe.

Also to be noted is that as with the Type 1 heat exchanger assembly, the present invention referred to as the Type 2 heat exchanger assembly configuration has also been designed to be utilized in conjunction with gas turbine powered electrical generator basically according to the teachings of the previous invention, but not in any way limited to that application.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

I claim:

1. A heat exchange device comprising:

a) a center tube assembly engaged to an exhaust manifold;

b) a plurality of heat exchange tubes positioned around an exterior of the center tube assembly, wherein each of the plurality of heat exchanger tubes is configured to direct a flow of secondary heated fluid therein;

c) a flange at an upper end of the center tube assembly, wherein the flange is attached to the center tube assembly and each of the plurality of heat exchanger tubes, wherein a primary heated fluid passes from an interior of the center tube assembly to an exterior of the plurality of heat exchange tubes, wherein the primary heated fluid and the secondary heated fluid are separated;

d) a cover removably engaged to the flange, wherein a space between the cover and the flange facilitates a flow of the primary heated fluid from center tube assembly to each of the plurality of heat exchange tubes; and e) a heat source disposed within the center tube assembly between the exhaust manifold and the upper end.

2. The device of claim 1, wherein the heat source heats the primary fluid within the center tube assembly.

3. The device of claim 1, wherein the exhaust manifold further comprises one or more removable end plates, wherein the removable end plates allow access to an interior of the exhaust manifold.

4. The device of claim 1, wherein the center tube assembly has a hollow interior from the upper end to a lower end, wherein the lower end is in contact with a spacer plate, wherein the spacer is positioned between the center tube assembly and the exhaust manifold, wherein ambient fluid is drawn into the center tube assembly through the spacer plate.

5. The device of claim 4, wherein the fluid is drawn into the center tube assembly by at least one fan, wherein the at least one fan forces fluid into the center tube assembly, wherein the forced fluid contacts the heat source.

6. The device of claim 5, further comprising a heat shield assembly surrounding the plurality of heat exchanger tubes, wherein the heat shield assembly is attached to the exhaust manifold.

7. The device of claim 1, wherein the cover facilitates access to an interior of the central tube assembly.

8. The device of claim 1, further comprising an electrical ignition configured to initiate the heat source, wherein a fuel source is in communication with the heat source within the central tube assembly.

* * * * *